US006975194B2

(12) United States Patent
Nishida et al.

(10) Patent No.: US 6,975,194 B2
(45) Date of Patent: Dec. 13, 2005

(54) SWITCHING DEVICE

(75) Inventors: Takeshi Nishida, Muko (JP); Yasuyuki Masui, Otsu (JP); Kozo Maenishi, Nagaokakyo (JP)

(73) Assignee: Omron Corporation, Kyoto (JP)

( * ) Notice: Subject to any disclaimer, the term of this patent is extended or adjusted under 35 U.S.C. 154(b) by 10 days.

(21) Appl. No.: 10/638,283

(22) Filed: Aug. 8, 2003

(65) Prior Publication Data

US 2004/0066261 A1 Apr. 8, 2004

(30) Foreign Application Priority Data

Aug. 9, 2002 (JP) ..... 2002-233201

(51) Int. Cl.[7] ..... H01H 67/02
(52) U.S. Cl. ..... 335/132; 335/201

(58) Field of Search ..... 335/132, 201–202, 335/165–176, 220–234, 126; 200/243, 1 B, 200/18

(56) References Cited

U.S. PATENT DOCUMENTS 3,493,702 A * 2/1970 Ramstetter ..... 200/451
5,546,061 A * 8/1996 Okabayashi et al. ..... 335/78
5,744,766 A * 4/1998 Sambar et al. ..... 200/16 A

* cited by examiner

*Primary Examiner*—Lincoln Donovan
(74) *Attorney, Agent, or Firm*—Osha Liang LLP

(57) ABSTRACT

A switching device which can be small-sized by improving a shielding performance and can improve the reliability of switching characteristics. A permanent magnet disposed near stationary contacts is arranged in its pole-face perpendicularly of the axis of a moving contact member.

8 Claims, 15 Drawing Sheets

SWITCHING DEVICE

CROSS-REFERENCE TO RELATED APPLICATIONS

This application claims priority from Japanese Patent Application No. 233201/2002 filed Aug. 9, 2002.

BACKGROUND OF THE INVENTION

1. Field of the Invention

The present invention relates to a switching device and, more particularly, to a switching device such as an electromagnetic relay, a switch or a timer for switching an electric current.

2. Description of the Related Art

As the switching device for closing the DC electric current, there is a closed type relay device, as disclosed in JP-T-9-510040, for example) in the prior art.

As a coil portion 40 is magnetized and demagnetized, more specifically, a plunger 9 is brought into and out of contact with a core center 4 so that an armature assembly 8, as integrated with the plunger 9, and an armature shaft 10 are slit in the axial direction to bring a moving contact disc 21 into and out of contact with stationary contacts 22 and 22.

In the closed type relay device, the arc current, as produced when the moving contact disc 21 is brought into and out of contact with the stationary contacts 22 and 22 is broken by extending it outward with the magnetic force of a permanent magnet 33 packaged in the stationary contact 22.

However, a predetermined extension is needed for extending and breaking the arc current. Therefore, the closed type relay device cannot reduce the size of a structure 3 housing the stationary contact 22 and the moving contact disc 21, so that its size reduction is limited.

Even if the directivity for mounting the permanent magnet 33, i.e., the so-called "polarity" is arranged conforming the specifications, according to the aforementioned closed type relay device, the arc current produced is extended inward when the current flow direction in use is reversed from that of the specifications, so that it is difficult to break. When an AC current is to be switched by the closed type relay device, moreover, the AC current flow direction periodically changes so that the arc current produced at the switching time is extended not only outward but also inward. As a result, the arc current produced cannot be easily broken in a reliable manner, thus causing a problem that the reliability of the switching characteristics is low.

SUMMARY OF THE INVENTION

In view of this problem, the invention has an object to provide a switching device, which can be small-sized by improving a shielding performance and can improve the reliability of switching characteristics.

In order to achieve this object, according to the invention, there is provided a switching device for making/breaking contact by bringing one end portion of a moving contact member into and out of contact with stationary contacts, comprising: a permanent magnet disposed near the stationary contacts and having its pole-face arranged perpendicularly of the axis of the moving contact member.

According to the invention, the arc current produced at the switching time is so extended on the basis of the Fleming's left-hand law (or by the Lorentz's force) as to whirl along the pole-faces of the permanent magnets, until it is broken.

Therefore, a large space is not required for breaking the arc current unlike the examples of the prior art, so that the device can be small-sized.

Even if the flow direction of the current to be broken in use is reversed, moreover, the whirling direction of the arc current produced changes to clockwise or counterclockwise. Specifically, it is unchanged that the arc current whirls along the pole-faces of the permanent magnets, so that the arc current produced can be reliably broken. Even if the current flow direction periodically changes as in case the AC current is to be switched, moreover, the produced arc current whirls alternately in the opposite directions along the pole-faces of the permanent magnets. As a result, the arc current can be reliably broken no matter whether it might be a DC current or an AC current, so that the reliability of the switching characteristics is improved.

In an embodiment of the invention, the two end portions of the moving contact member may be brought into and out of contact with the stationary contacts.

This embodiment can also be applied to the moving contact member having its two end portions brought into and output the stationary contacts, so that its application is widened.

In another embodiment of the invention, a plurality of moving contact members may be juxtaposed to each other.

According to this embodiment, the moving contact members are juxtaposed so that the arc voltage is lowered by the current-limiting effect. As a result, the arc is reluctant to occur or can be broken if produced.

In a different embodiment of the invention, a step may be formed between the adjacent moving contact members.

According to this embodiment, a time lag is established between a plurality of contact switching actions. By making the material of the moving contact member different, therefore, the contact wear by the making current can be suppressed to elongate the contact lifetime.

In another embodiment of the invention, the permanent magnets arranged on the two end sides of the moving contact member may be arranged in polarity in an identical direction.

According to this embodiment, the arc current produced is so relatively extended in the opposite direction as to whirl. Therefore, the heat is not applied only to one side of the housing so that it can be dispersed over a wide range thereby to provide a switching device having excellent cooling properties.

According to a different embodiment of the invention, a shielding wall may be interposed between the permanent magnets, the moving contact member and the stationary contacts for shielding at least the pole-faces of the permanent magnets.

According to this embodiment, the pole-faces of the permanent magnets are protected by the shielding wall thereby to provide an effect that the permanent magnets can be prevented from aging.

DESCRIPTION OF THE PREFERRED EMBODIMENTS

Figure 1:
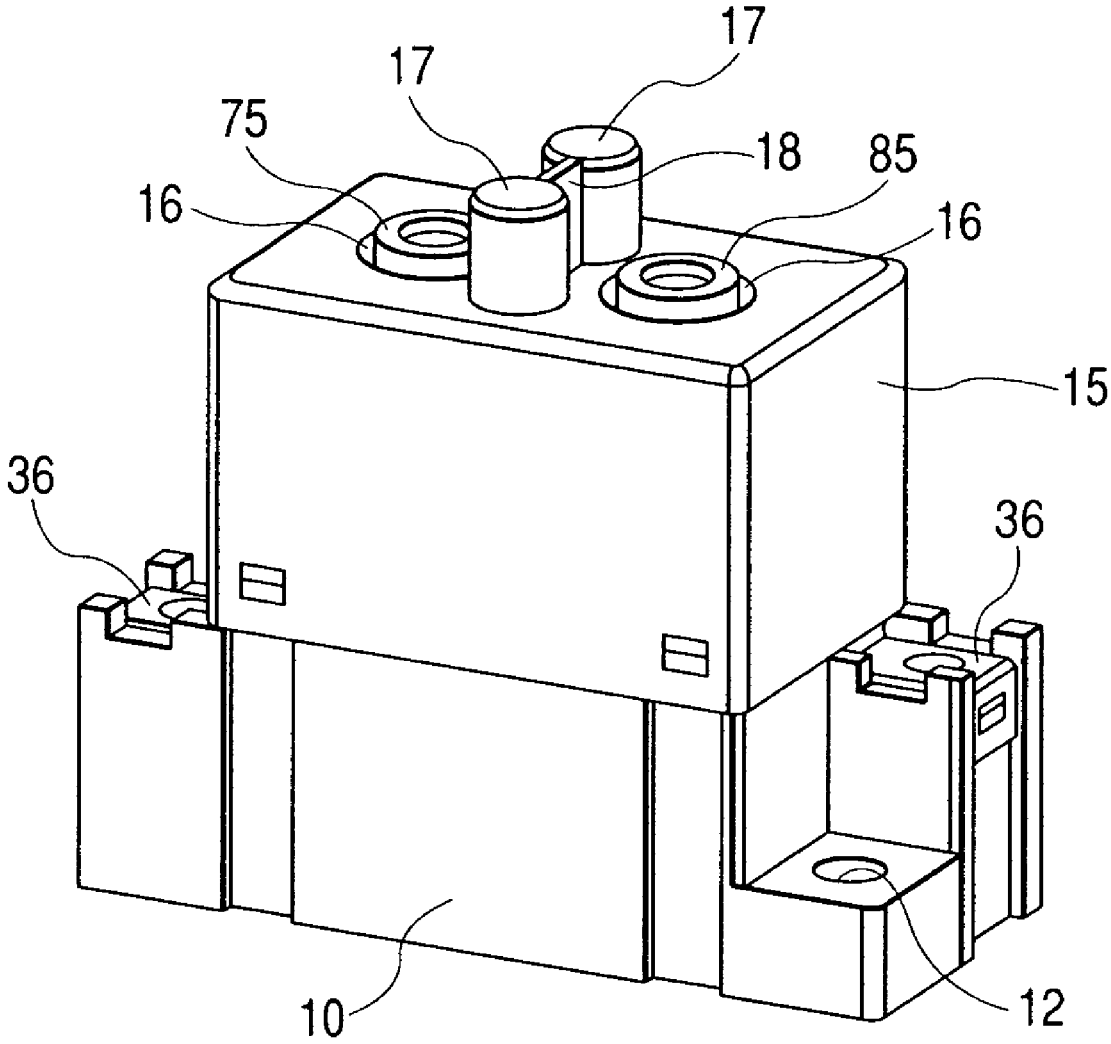
FIG. 1 is a perspective view showing an embodiment of the case, in which a switching device according to the invention is applied to a DC current breaking relay.

Embodiment according to the invention will be described with reference to FIG. 1 to FIG. 15. The first embodiment of the invention is applied to a DC load switching relay, in which a relay body 20 is housed in a space defined by a box-shaped case 10 and a box-shaped cover 15 integrated, as shown in FIG. 1 and FIG. 2.

Figure 2:
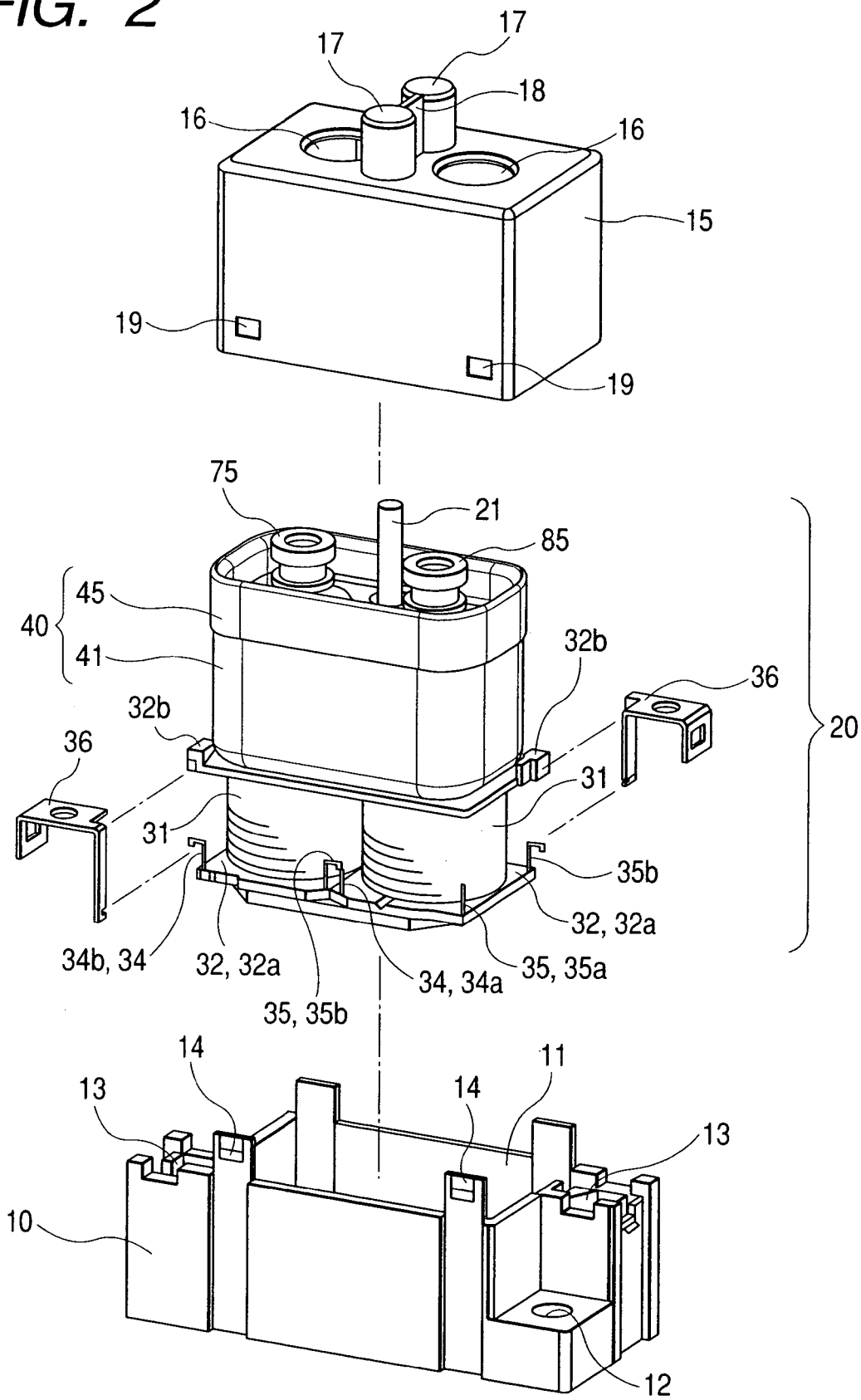
FIG. 2 is an exploded perspective view of FIG. 1.

The box-shaped case 10 is provided, as shown in FIG. 2, with: a recess 11 for housing a later-described electromagnet block 30; fixing through holes 12 in a pair of plane corners positioned on a diagonal line; and connecting recesses 13 positioned in the remaining plane corners. In the connecting recesses 13, connecting nats (not shown in the figure) are embedded.

The box-shaped cover 15 is so shaped that it can fit the box-shaped case 10 and can house a later-described sealing case block 40. In the ceiling of the box-shaped cover 15, moreover, there are formed connecting holes 16 and 16, from which there are protruded connecting terminals 75 and 85 of the relay body 20. From the ceiling of the box-shaped cover 15, moreover, there are protrusions 17 and 17 for housing a gas vent pipe 21. The protrusions 17 and 17 are connected through a partition wall 18 and have a function as an insulating wall together. By engaging engaged holes 19, which are formed in the edge portion of the lower opening of the box-shaped cover 15, with engaging pawls 14, which are formed on the edge portion of the upper opening of the box-shaped case 10, moreover, the cover 15 and the case 10 are integrally jointed to each other.

Figure 3:
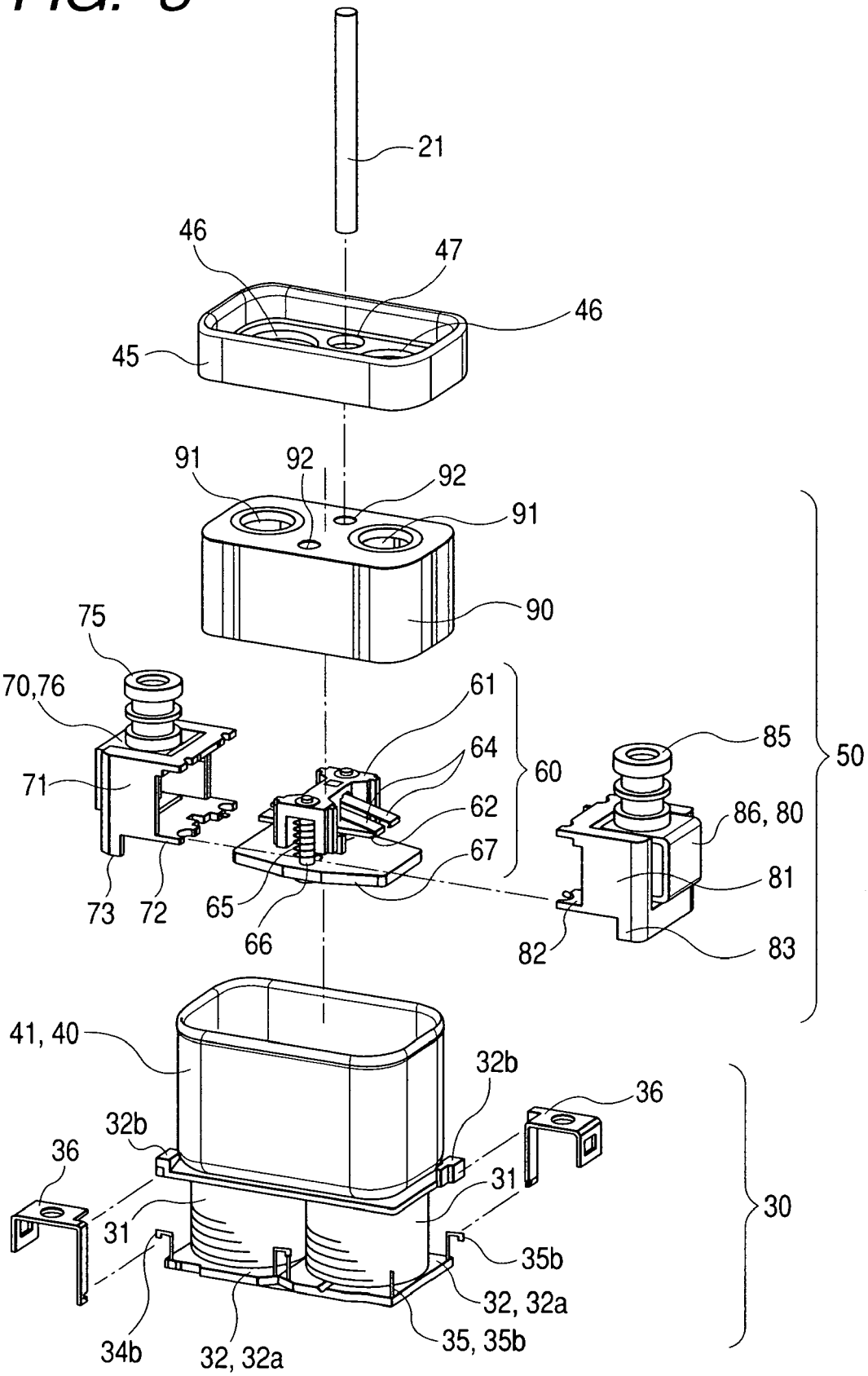
FIG. 3 is an exploded perspective view of a relay body shown in FIG. 2.

In the relay body 20, as shown in FIG. 3, a contact mechanism block 50 is sealed in the sealing case block 40 mounted on the electromagnet block 30.

Figure 4:
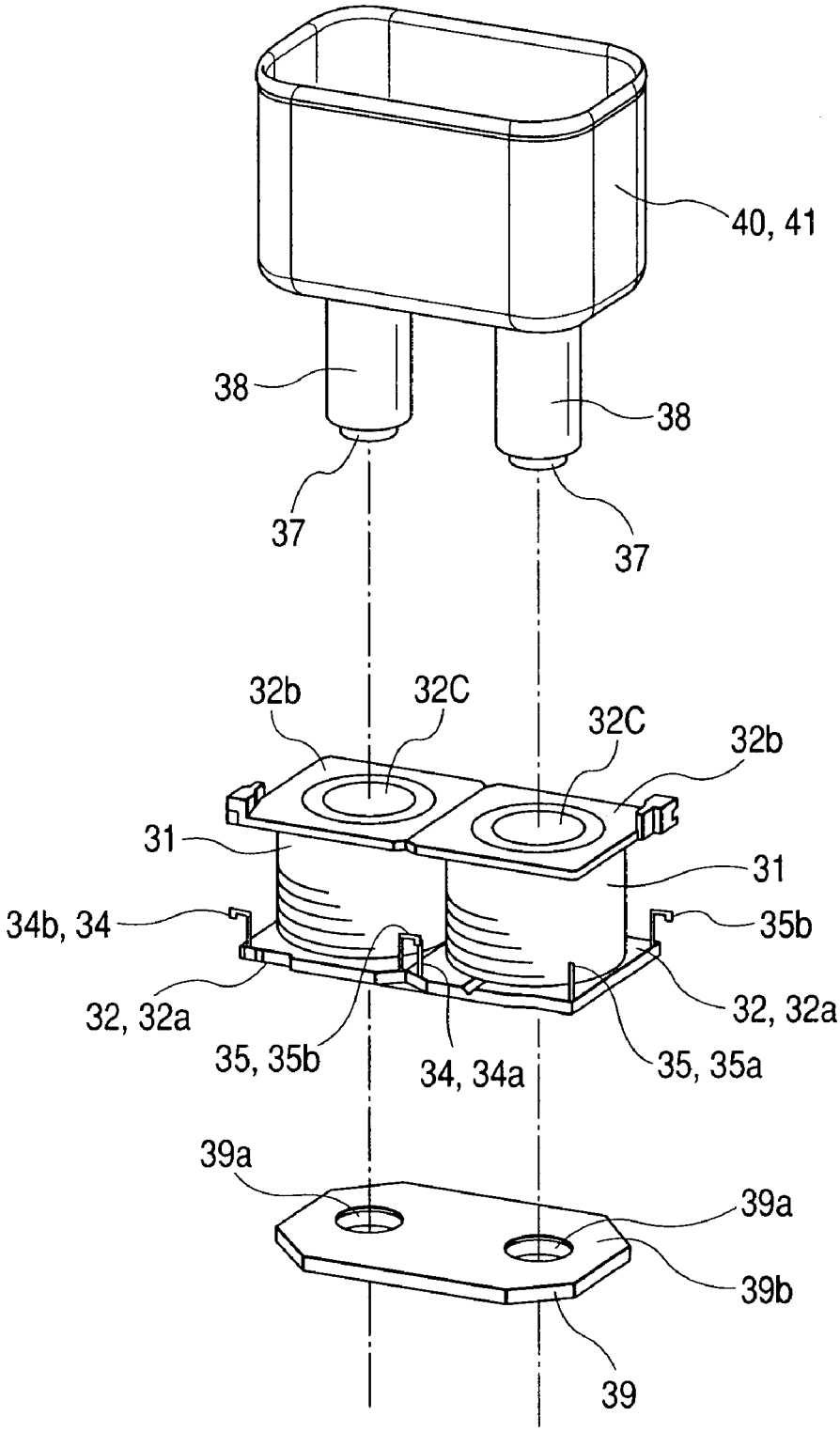
FIG. 4 is an exploded perspective view of an electromagnet block shown in FIG. 3.

This electromagnet block 30 is as shown in FIG. 4, so integrated that a pair of spools 32 wound with coils 31 are juxtaposed to each other around two iron cores 37 and through a yoke 39.

Relay terminals 34 and 35 are individually press-fitted on the two opposed side end faces of the lower one 32*a* of flange portions 32*a* and 32*b* at the two ends of the spools 32. And, the coil 31 wounded on the spools 32 is bound and soldered at its one-end portion to the one-end portion (or bind portions) 34*a* of one relay terminal 34 and is bound and soldered at its other end (bind portion) to one-end portion (or bind portion) 35*a* of the other relay terminal 35. In the relay terminals 34 and 35, moreover, not only the bind portions 34*a* but also other end portions (or joint portions) 35*b* are bent up. Of the relay terminals 34 and 35 assembled with the juxtaposed spools 32 and 32, the joint portion 35*b* of the relay terminal 35 and the bind portion 34*a* of the other relay terminal 34 are jointed and soldered to each other. Of the adjacent relay terminals 35 and 34, moreover, the bind portion 35*a* and a joint portion 34*b* are jointed and soldered to each other. Thus, the two coils 31 and 31 are connected. Moreover, the paired flange portions 32*a* and 32*b* of the spools 32 are individually spanned with coil terminals 36 and 36 and connected to the joint portions 34*b* and 35*b* of the relay terminals 34 and 35.

The sealing case block 40 is constructed to include a sealing case 41 capable of housing the later-described contact mechanism block 50, and a sealing cover 45 for sealing the opening of he sealing case 41. In the bottom face of the sealing case 41, there are formed a pair of press-fit holes 42 (FIG. 5) for press-fitting the icon cores 37. In the sealing cover 45, on the other hand, there are formed a pair of insert holes 46 and 46 capable of inserting the connecting terminals 75 and 85 of the later-described contact mechanism block 50, and a loosely fitting hole 47 capable of fitting the gas vent pipe 21 loosely.

The electromagnet block 30 and the sealing case 40 are assembled in the following procedure.

First of all, the relay terminals 34 and 35 are individually press-fitted in the flange portions 32*a* of the spools 32 whereas the coils 31 are wound on the spools 32, and the lead wires are individually bound on the soldered to the bind portions 34*a* and 35*a* of the relay terminals 34 and 35. Next, there are juxtaposed the paired spools 32, from which the bind portions 34*a* and 35*a* and the joint portions 34*b* and 35*b* of the relay terminals 34 and 35 are bent up. Moreover, the bind portion 35*a* of the relay terminal 35 and the joint portion 34*b* of the other relay terminal 34 are jointed and soldered to each other. Moreover, the coils 31 and 31 are connected by jointing and soldering the joint portion 35*b* of the relay terminal 35 and the bind portion 34*a* of the other relay terminal 34.

Figure 5:
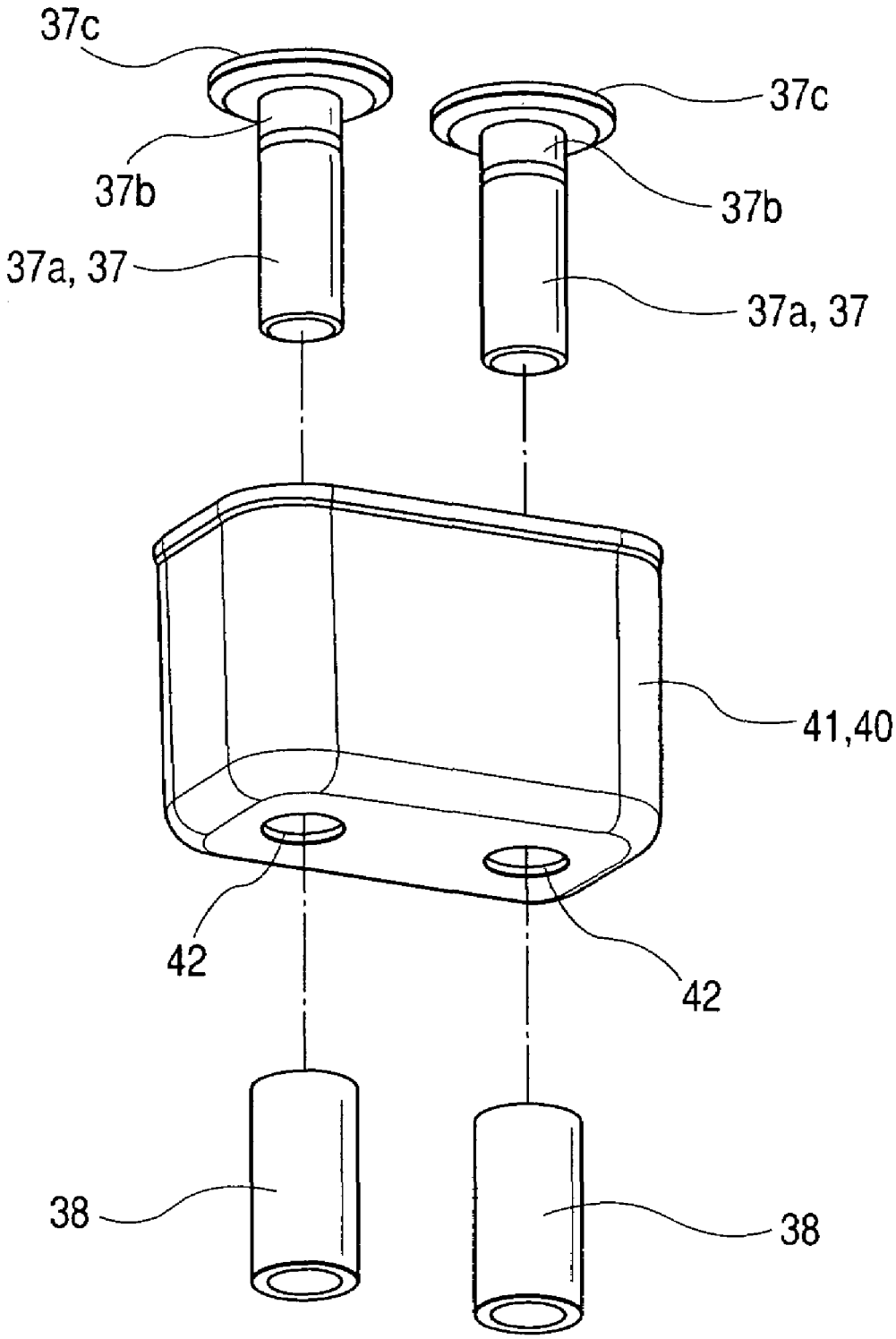
FIG. 5 is an exploded perspective view of a sealing case shown in FIG. 4.
Figure 6B:
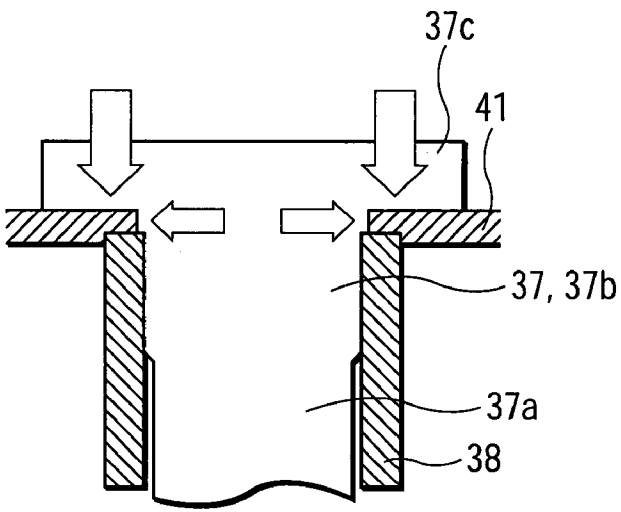
FIGS. 6A and 6B are enlarged sectional views showing a method for caulking the sealing case shown in FIG. 5.
Figure 6A:
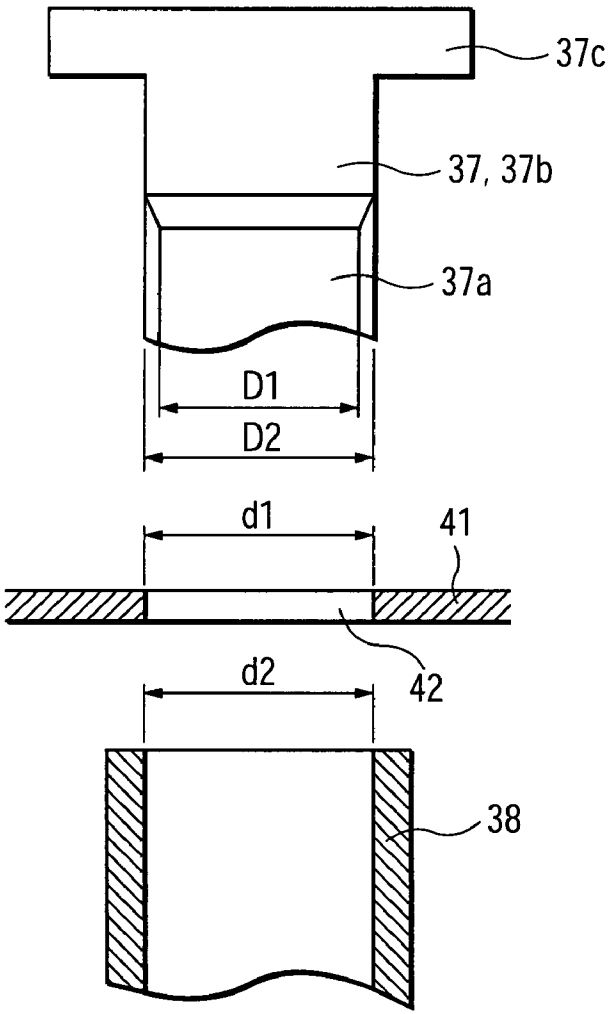

As shown in FIG. 5, on the other hand, the iron cores 37 are individually inserted into the press-fit holes 42 formed in the bottom face of the sealing case 41, and pipes 38 are fitted on the protruding stems 37*a* of the iron cores 37. And, the iron cores 37 are pushed in the axial direction from the open edge portions of the pipes 38. As shown in FIG. 6, the iron core 37 is made smaller at the diameter D1 of its stem portion 37*a* than the diameter d1 of the press-fit hole 42 of the sealing case 41 and the internal diameter d2 of the pipe 38. However, the diameter D2 of the neck portion 37*b* of the iron core 37 is made larger than the diameter d1 of the press-fit hole 42 of the sealing case 41 and the internal diameter d2 of the pipe 38. When the iron core 37 is pushed in the axial direction, the neck portion 37*b* of the iron core 37 is press-fitted in the press-fit hole 42 of the sealing case 41 while widening it and the internal diameter of the pipe 38. Moreover, the open edge portion of the pipe 38 and the head portion (or magnetic pole portion) 37*c* of the iron core 37 push the open edge portion of the press-fit hole 42 of the sealing case 41 from above and below. There, the open edge portion of the press-fit hole 42 of the sealing case 41 is caulked and fixed from the three sides.

According to this embodiment, the sealing case 41 is made of such a material, e.g., aluminum as has a larger coefficient of thermal expansion than those of the iron cores 37 and the pipes 38. Therefore, the embodiment is advantageous in that the gas-tightness is not deteriorated even if the temperature changes.

The reason for this advantage will be described in the following. Even if the temperature rises so that the individual parts expand, the expansion of the sealing case 41 in the thickness direction is larger than those of the remaining parts so that the sealing case 41 is firmly clamped between the head portions 37*c* of the iron cores 37 and the pipes 38. Even if the temperature drops so that the individual parts shrink, on the other hand, the shrinkage of the press-fit holes 42 of the sealing case 41 in the diametrical direction is larger than those of the remaining parts so that the sealing case 41 fastens the neck portions 37*b* of the iron cores 37.

In order to prevent the thermal stress while retaining the gas-tightness, it is preferred that the iron cores 37 and the pipes 38 have substantially equal coefficients of thermal expansion.

Then, the iron cores 37 and the pipes 38 are individually inserted into center holes 32*c* of the spools 32, and the leading end portions of the protruding iron cores 37 are inserted into and caulked by caulking holes 39*a* of the yoke 39. Thus, the electromagnet block 30 is completed while mounting the sealing case 41. Between the yoke 39 and the flange portions of the spools 32, there is sandwiched an insulating sheet 39*b* (FIG. 4) for enhancing the insulating performance.

Next, the paired flange portions 32*a* and 32*b* of the spools 32 are individually spanned with the coil terminals 36, and the lower end portions of these coil terminals 36 are jointed to the joint portions 34*b* and 35*b* of the relay terminals 34 and 35.

The contact mechanism block 50 is constructed, as shown in FIG. 3, to include a moving contact block 60, stationary contact blocks 70 and 80 assembled on the two sides of the moving contact block 60, and an insulating case 90 fitted to integrate those blocks 60, 70 and 80.

Figure 7A:
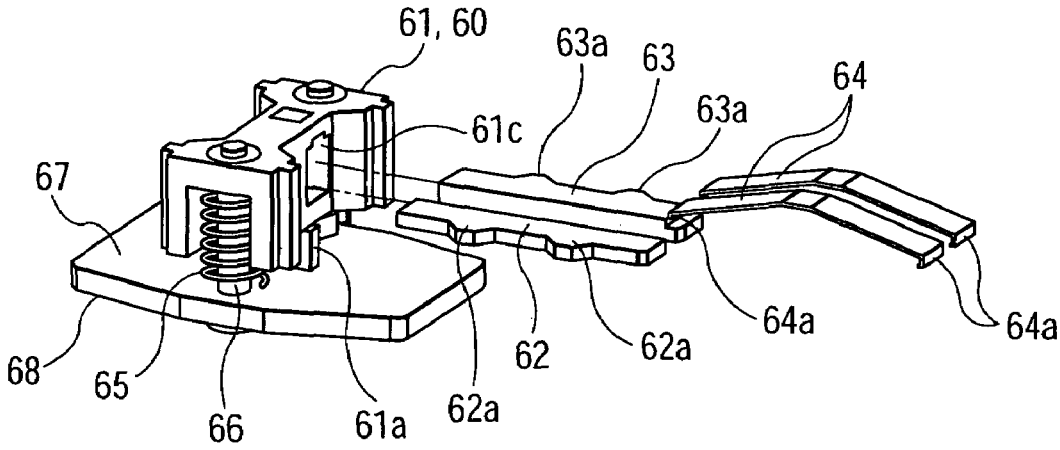
FIGS. 7A and 7B are exploded perspective views of a moving contact block shown in FIG. 3.
Figure 7B:
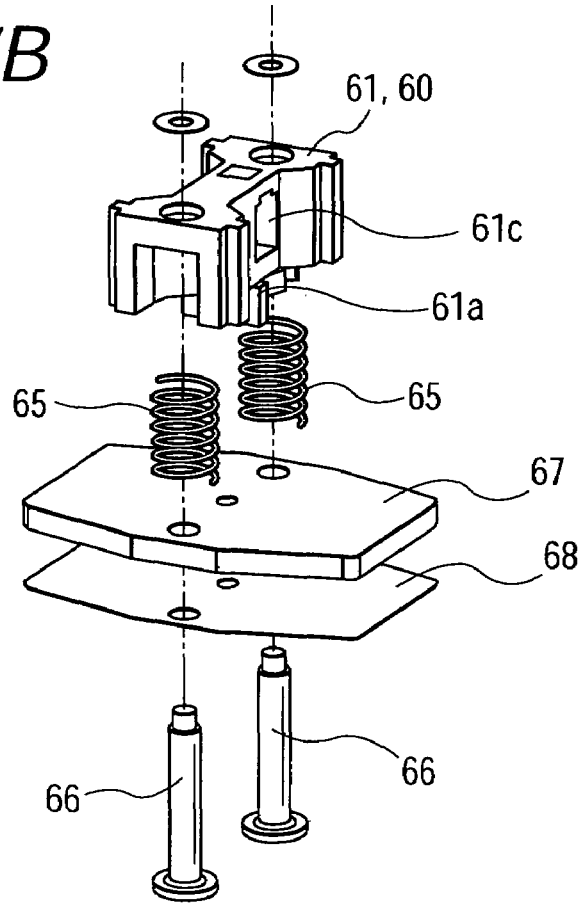

The moving contact block 60 is constructed, as shown in FIG. 7A, by assembling a pair of juxtaposed moving contact members 62 and 63 and contact springs 64 individually with a moving insulating bed 61. The moving insulating bed 61 is constructed, as shown in FIG. 7B, such that a leg portion 61*a* having a generally cross-shape section is protruded from the lower face of its central portion and such that a moving iron member 67 is caulked and fixed on its two side portions through rivets 66 having coiled return springs 65 fitted thereon. The moving iron member 67 is covered on its lower face with a shielding sheet 68.

A pair of retained protrusions 62*a* and 63*a* are individually protruded from the one-side edge portions of the band-shaped conductive materials of the moving contact members 62 and 63. Of the moving contact members 62 and 63, the moving contact member 62 is made of a band-shaped conductive member of molybdenum having a high melting point and capable of enduring a rush current, and the other moving contact member 63 is made of a thick band-shaped copper sheet plated with silver.

The contact springs 64 are arranged for applying a contact pressure to the moving contact members 62 and 63. And, the contact springs 64 are made by bending band-shaped spring materials generally into an angle shape and are folded at their two side edge portions to form retained pawls 64*a* and 64*a*.

These retained pawls 64*a* of the contact springs 64 are retained on the two end portions of the moving contact members 62 and 63, when the moving contact members 62 and 63 and the contact springs 64 and 64 are inserted into and assembled with a pair of assembling holes 61*b* and 61*c* juxtaposed in the moving insulating bed 61. As a result, the moving contact members 62 and 63 can be prevented from becoming vertically loose. Moreover, the retained protrusions 62*a* and 63*a* of the moving contact members 62 and 63 are retained on the open edge portions of the assembling holes 61*b* and 61*c* of the moving insulating bed 61, so that the contact springs 64 and the moving insulating beds 62 and 63 can be prevented from coming out. By positioning the moving contact member 62 at a lower height than that of the moving contact member 63, moreover, a step is formed between the paired moving contact members 62 and 63. As a result, the moving contact member 62 comes into contact with a stationary contact 78*a* before the moving contact member 63 comes into contact with a stationary contact 78*b*.

Figure 8A:
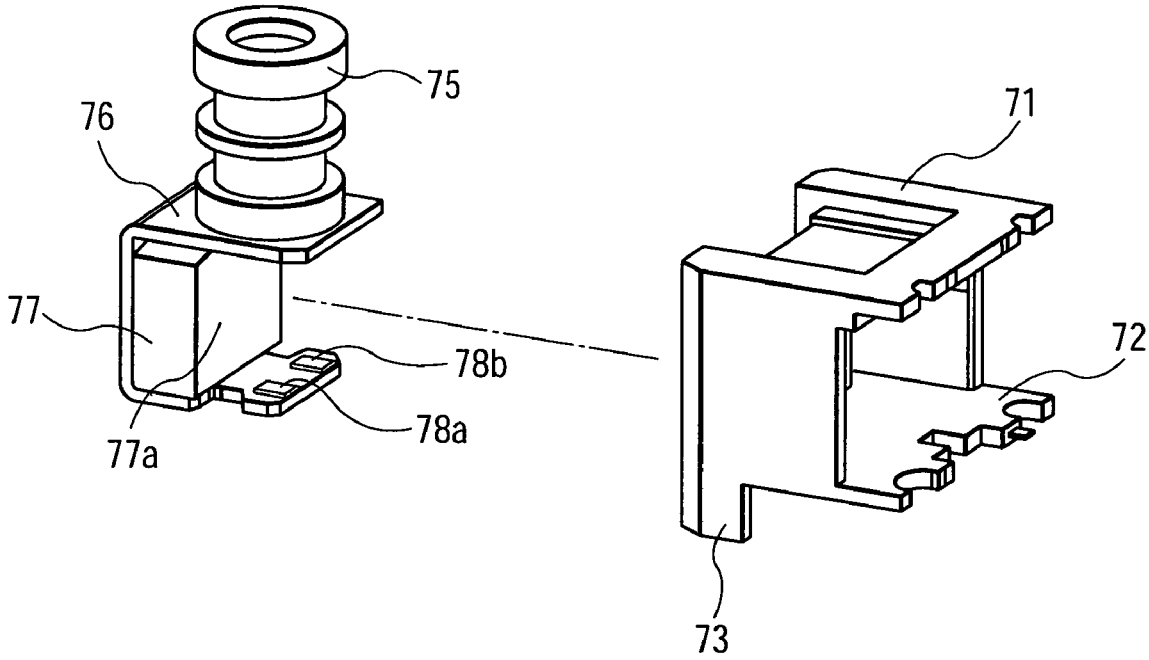
FIGS. 8A and 8B are exploded perspective views of a stationary contact block shown in FIG. 3.
Figure 8B:
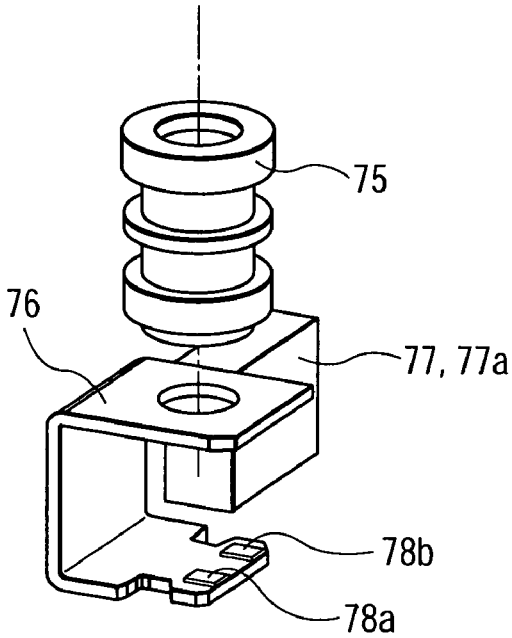
Figure 9A:
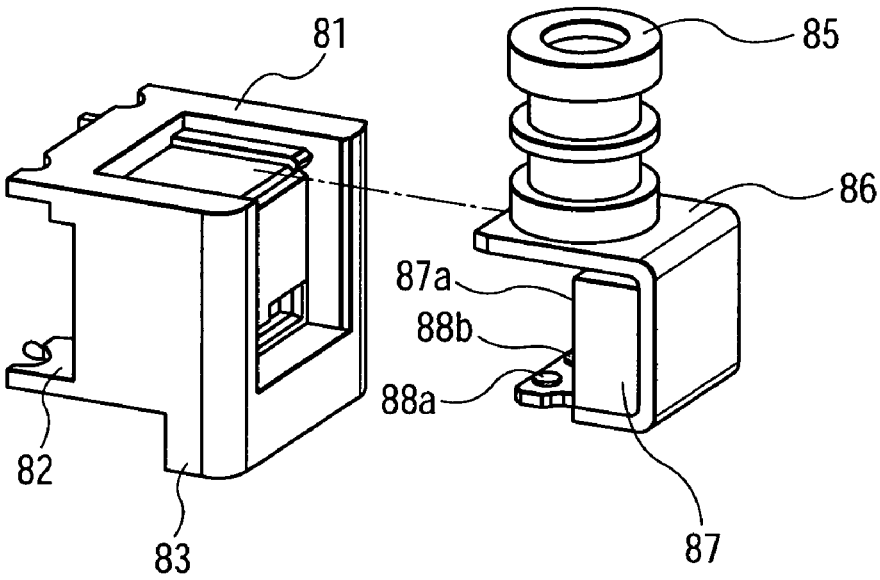
FIGS. 9A and 9B are exploded perspective views of the stationary contact block shown in FIG. 3.
Figure 9B:
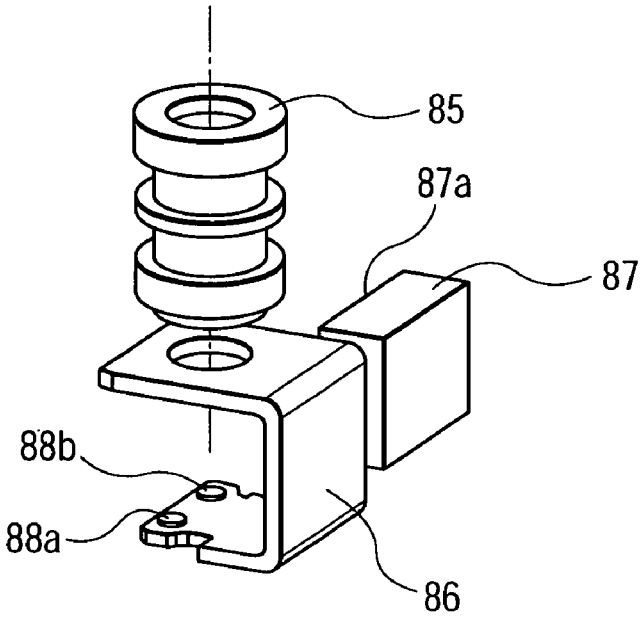
Figure 10:
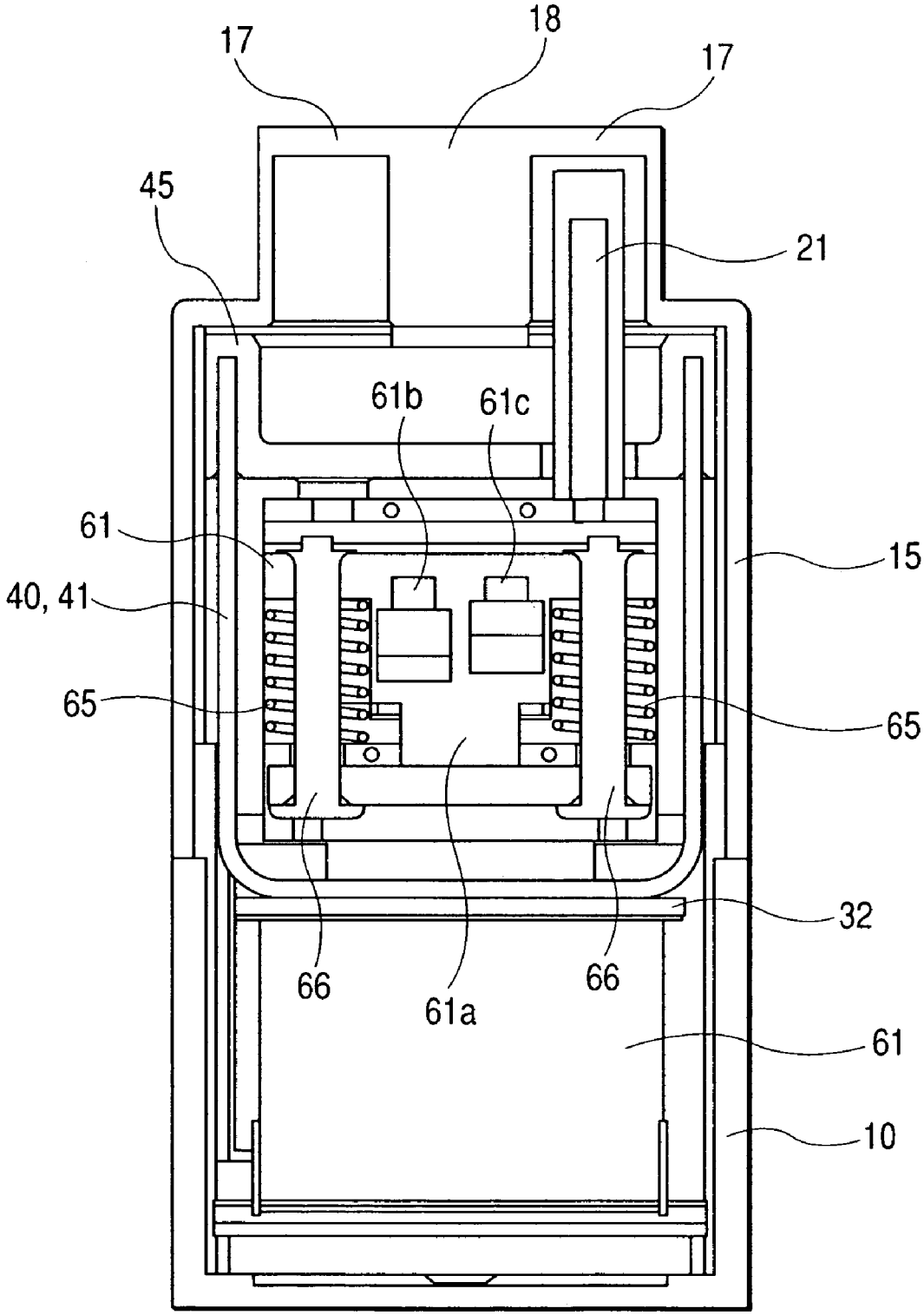
FIG. 10 is a longitudinal section of the switching device shown in FIG. 1.
Figure 11A:
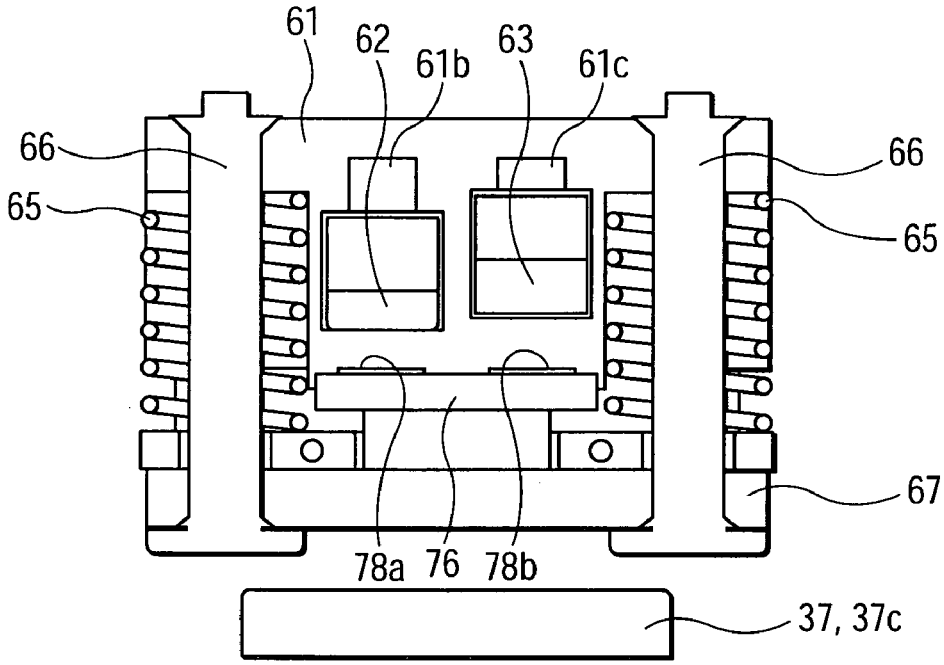
FIGS. 11A and 11B are partially enlarged sectional views of FIG. 10.
Figure 11B:
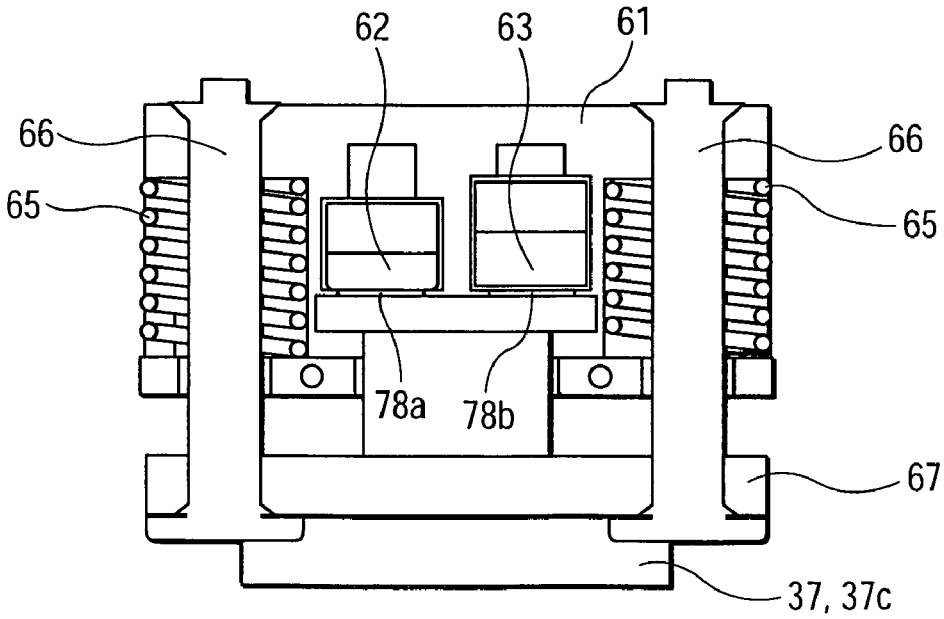
Figure 12:
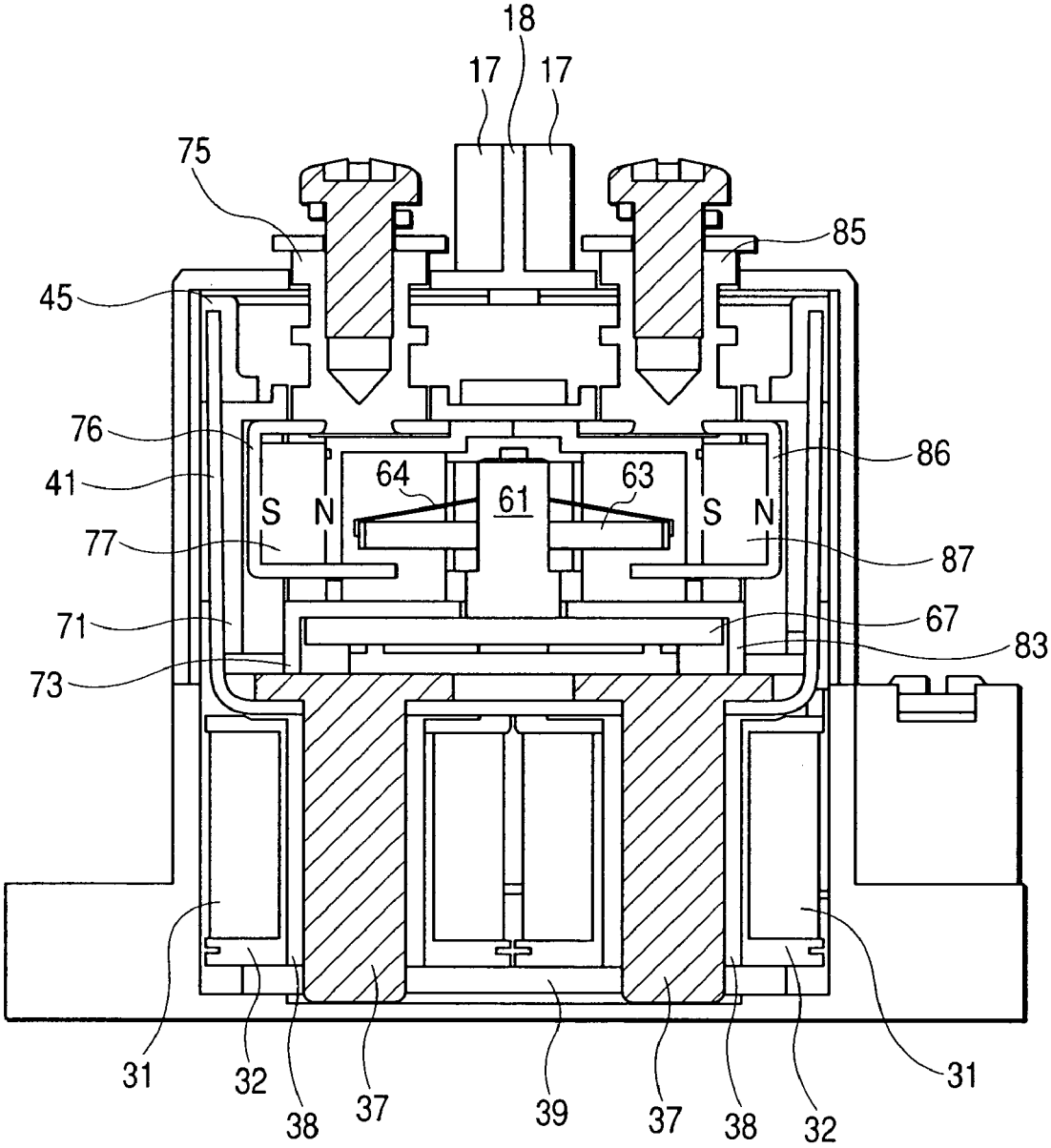
FIG. 12 is a longitudinal section showing the relay of the embodiment according to the invention and taken at a different angle.

The stationary contact blocks 70 and 80 are constructed, as shown in FIG. 8 and FIG. 9, such that stationary contact beds 71 and 81 molded of a resin to have an identical shape are assembled with stationary contact terminals 76 and 86, as made of a generally C-shaped section caulking and fixing the connecting terminals 75 and 85, and permanent magnets 77 and 87. The stationary contact beds 71 and 81 are constructed such that abutting protrusions 72 and 82 are individually protruded inward sideways and such that supporting leg portions 73 and 83 are individually protruded vertically downward.

The stationary contact terminals 76 and 86 are formed to have pairs of stationary contacts 78*a* and 78*b*, and 88*a* and 88*b*, respectively, by protruding their lower side edge portions. On the other hand, the permanent magnets 77 and 87 are assembled such that their pole-faces 77*a* and 87*a* are jointed to the inner faces of the stationary contact terminals 76 and 86. As a result, the pole-faces 77*a* and 87*a* of the permanent magnets 77 and 87 are positioned near the paired stationary contacts 78*a* and 78*b*, and 86*a* and 86*b*.

The insulating case 90 is provided for uniting the contact mechanism block 50, as shown in FIG. 3. And, the paired stationary contact blocks 70 and 80 are assembled from the two sides with the moving contact block 60 and are then fitted thereon, so that the connecting terminals 75 and 85 are protruded from terminal holes 91 and 91 of the insulating case 90. This insulating case 90 is provided with a pair of gas vent holes 92 near the terminals holes 91. The reason for the paired gas vent holes 92 is to eliminate the directivity at the assembling time.

Here will be described the procedure for assembling the contact mechanism block 50.

At first, the moving iron member 67 and the shielding sheet 68 are assembled with the moving insulating bed 61 through the rivets 66 inserted into the return springs 65. And, the moving contact members 62 and 63 and the contact springs 64 and 64 are assembled with the moving insulating bed 61. Next, the stationary contact blocks 70 and 80 are assembled from the two sides of the moving insulating bed 61 while raising the lower end sides of the return springs 65, thereby to bringing the abutting protrusions 72 and 82 into abutment against each other. Moreover, the insulating case 90 is fitted on the stationary contact blocks 70 and 80. Thus, the contact mechanism block 50 is completed.

Next, the contact mechanism block 50 is inserted into the sealing case 41 mounted on the electromagnet block 30. Then, the leg portions 73 and 83 of the stationary contact blocks 70 and 80 abut against the head portions 37*c* or the magnetic pole portions of the iron cores 37 so that the moving iron member 67 can come close to and apart from the magnetic pole portions 37*c* through the shielding sheet 68. And, the sealing cover 45 is fitted in and welded integrally with the sealing case 41. Moreover, the gas vent pipe 21 is press-fitted from the loosely fitting hole 47 into the gas vent hole 92 of the insulating case 90. Next, a sealing material (although not shown) is injected onto the sealing cover 45 and is solidified to seal around the base portions of the connecting terminals 75 and 85 and the gas vent pipe 21. And, the air in the sealing case 40 is vented from the gas vent pipe 21, and a predetermined mixture gas is injected. After this, the gas vent pipe 21 is caulked and sealed. And, the paired flange portions 32*a* and 32*b* of the spools 32 are spanned with the coil terminals 36. Thus, the relay body 20 is completed.

And, this relay body 20 is housed in the recess 11 of the case 10, and the coil terminals 36 are arranged in the connecting recesses 13. Moreover, the cover 15 is assembled with the case 10. Thus, the DC current breaking relay is completed.

Here will be described the actions of the relay thus constructed.

First of all, in case no voltage is applied to the coils 31 of the electromagnet block 30, the moving insulating bed 61 is pulled up (FIG. 13A) by the spring forces of the return springs 65 and 65. As a result, the moving iron member 67 leaves the magnetic pole portions 37*c* of the iron cores 37, and the two end portions of the moving contact members 62 and 63 leave the stationary contacts 78*a* and 88*a*, and 78*b* and 88*b*, respectively.

Figure 13A:
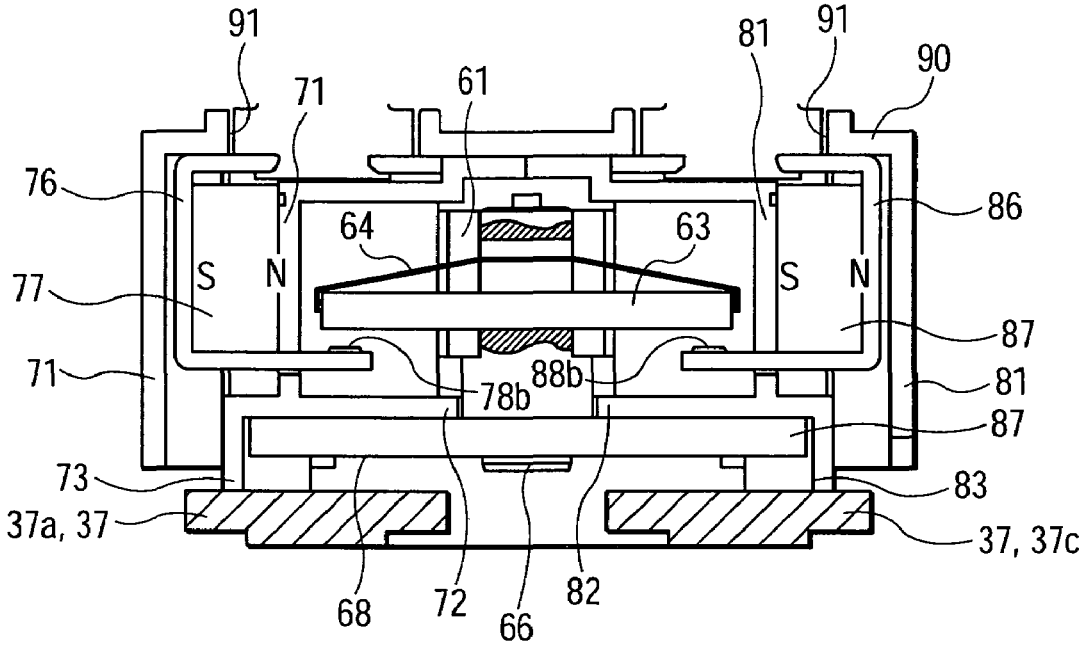
FIGS. 13A and 13B are partially enlarged views of FIG. 12.
Figure 13B:
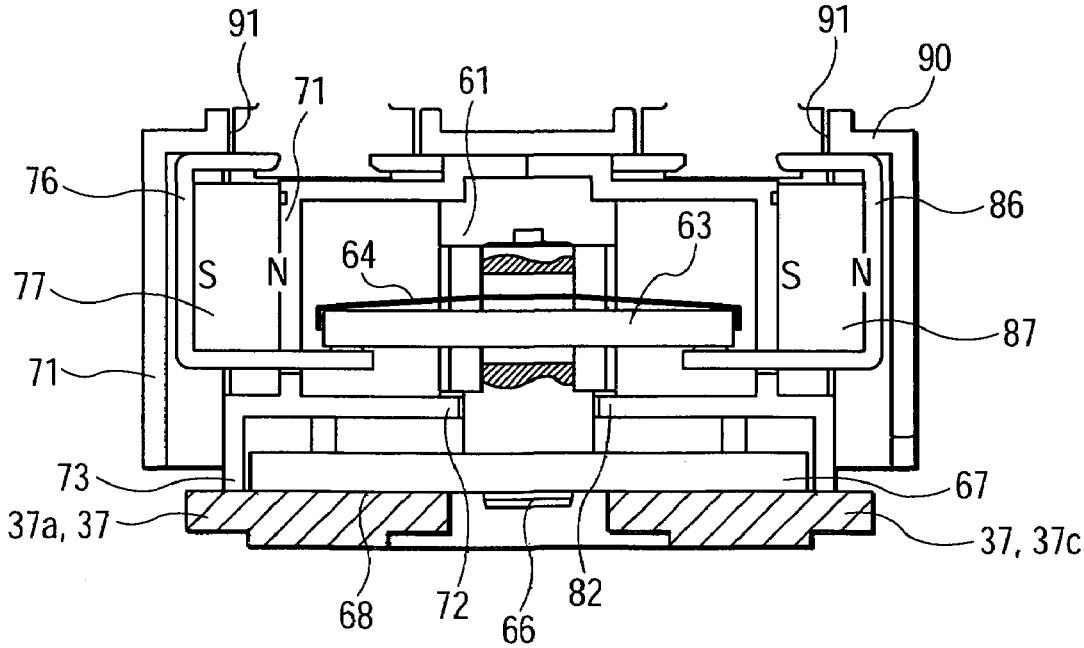
Figure 14:
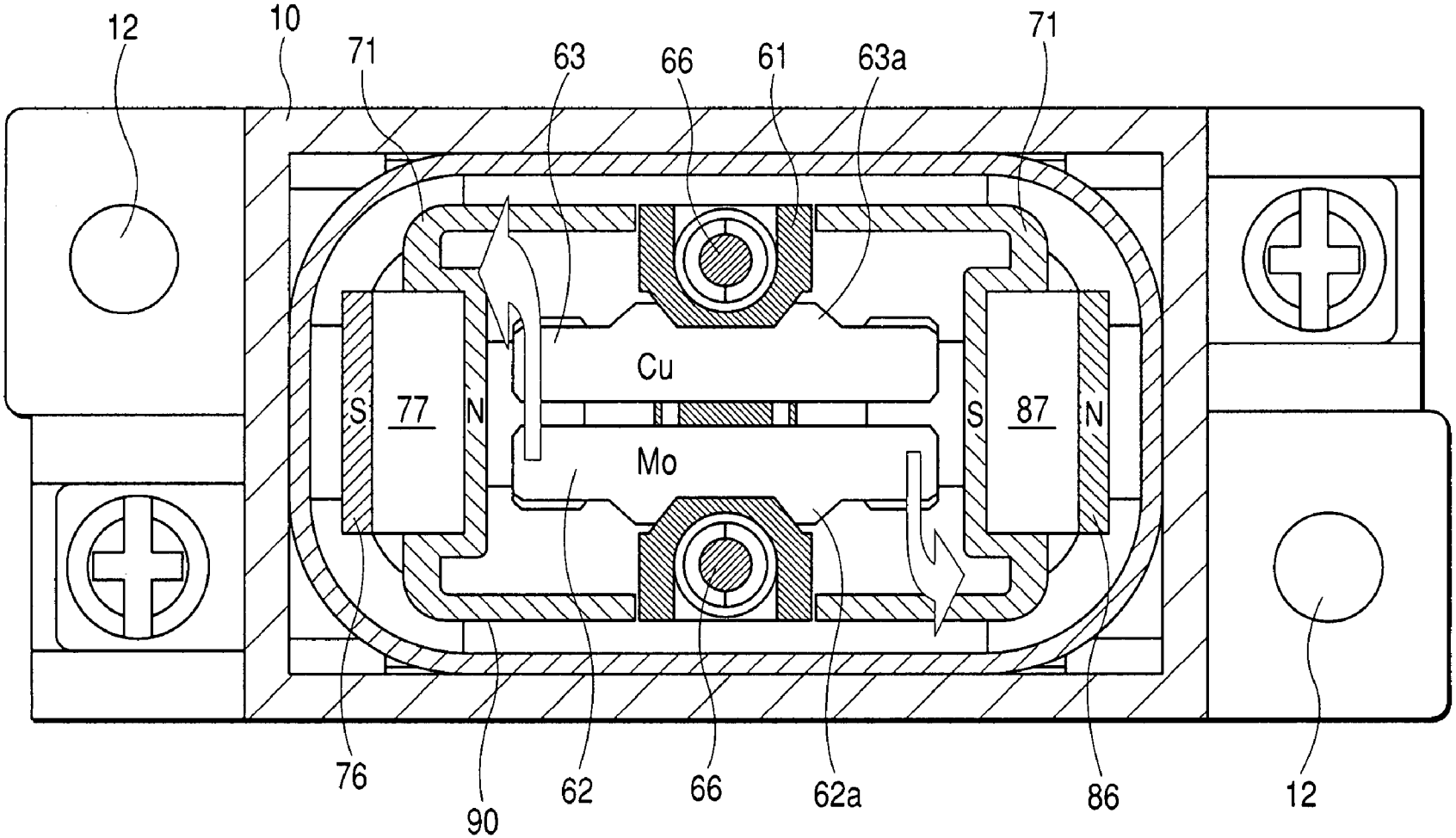
FIG. 14 is a transverse section of the switching device shown in FIG. 1.

When a voltage is applied to the coils 31, moreover, the magnetic pole portions 37*c* of the iron cores 37 attract the moving iron member 67 so that the moving iron member 67 moves downward against the spring forces of the return springs 65. As a result, the moving insulating bed 61, as integrated with the moving iron member 67, moves downward so that the two end portions of the moving contact member 62 come into contact with the stationary contacts 78*a* and 88*a*. Next, the two end portions of the moving contact member 63 come into contact with the stationary contacts 78*b* and 88*b* so that the moving iron member 67 is attracted by the magnetic pole portions 37*c* of the iron cores 37 (FIG. 13B).

Next, when the application of the voltage to the coils 31 is interrupted, the moving insulating bed 61 is pushed upward by the spring forces of the return springs 65 so that the moving iron member 67 leaves the magnetic pole portions 37*a* of the iron cores 37 together with the moving insulating bed 61. After the two end portions of the moving contact member 63 left the stationary contacts 78*b* and 88*b*, moreover, the two end portions of the moving contact member 62 leave the stationary contacts 78*a* and 88*a*.

An arc current, if produced when the two end portions of the moving contact member 62 leave the stationary contacts 78*a* and 88*a*, is attracted and broken by the magnetic forces of the permanent magnets 77 and 87. This point will be described in detail with reference to FIG. 14 and FIG. 15.

Figure 15:
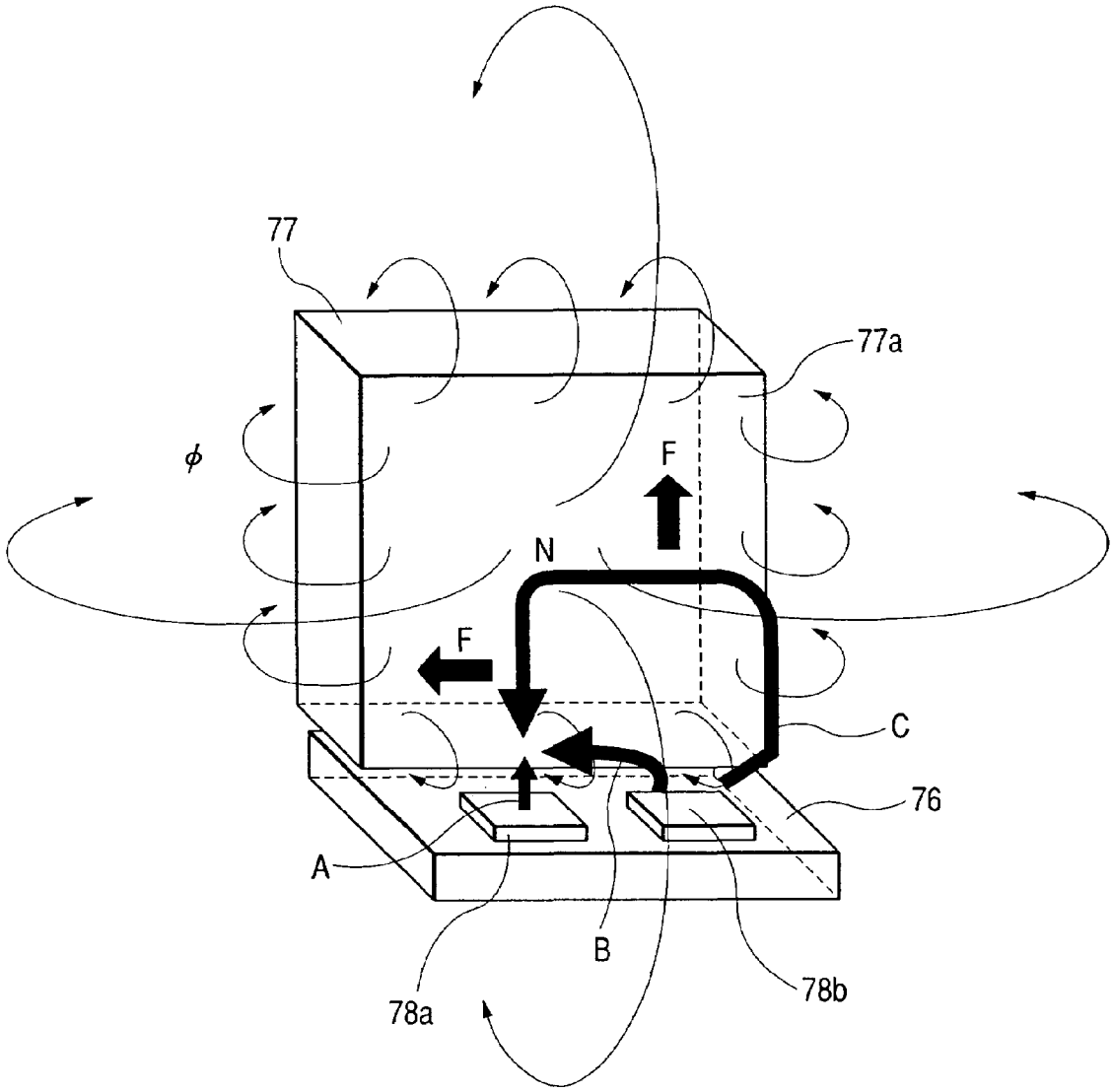
FIG. 15 is a schematic diagram showing an ark breaking mechanism according to an embodiment of the invention.

As shown in FIG. 15, for example, the magnetic flux of the permanent magnet 77 is emitted, as indicated by arrows, from the pole-face 77*a*. When the moving iron member 67 returns, moreover, the end portion of the moving contact member 63 leaves the stationary contact 78*b*, and the end portion of the moving contact member 62 leaves the stationary contact 78*a*. As a result, an arc current A begins to build up from the stationary contact 78*a*. According to Fleming's left-hand law (or by the Lorentz's force), however, the arc current A is attracted by the magnetic force of the permanent magnet 77, and it shifts its production place to the stationary contact 78*b* and turns into an arc current B. Moreover, this arc current B is extended into an arc current C by the magnetic force of the permanent magnet 77 so that it is finally cut and broken.

In this embodiment, the arc current is so extended on the basis of the Fleming's left-hand law as to swirl along the pole-faces 77*a* and 87*a* of the permanent magnets 77 and 87, until it is broken. Therefore, a large space is not required for breaking the arc current unlike the examples of the prior art, so that the device can be small-sized.

This embodiment has been described on the case, in which the DC current is broken, but may be applied to the case in which an AC current is broken. It is natural that the embodiment can also be applied not only to the relay but also to a switch, a timer or the like.

According to the invention, the arc current produced at the switching time is so extended on the basis of the Fleming's left-hand law (or by the Lorentz's force) as to whirl along the pole-faces of the permanent magnets, until it is broken. Therefore, a large space is not required for breaking the arc current unlike the examples of the prior art, thereby to provide an effect that the device can be small-sized.

What is claimed is:

1. A switching device for making/breaking contact by bringing one end portion of a moving contact member into and out of contact with stationary contacts, comprising:

a permanent magnet disposed near each of a pair of stationary contacts and having pole-faces arranged perpendicularly to an axis of said moving contact member, at least one stationary contact bed that forms a shielding wall extending along a surface of each permanent magnet to shield at least the pole face of each permanent magnet, wherein the shielding wall extends to at least a portion of at least one side face of each permanent magnet, and wherein the shielding wall is interposed between each permanent magnet and the moving contact member and one of the pair of stationary contacts, and at least one reentrant adjoined to the at least one side face of each permanent magnet formed by the at least one stationary contact bed.

2. A switching device according to claim 1, wherein two end portions of said moving contact member are brought into and out of contact with said stationary contacts.

3. A switching device according to claim 1, wherein a plurality of moving contact members are juxtaposed to each other.

4. A switching device according to claim 3, wherein a step is formed between the moving contact members.

5. A switching device according to claim 2, wherein permanent magnets are arranged on the two end portions of said moving contact member and are arranged in polarity in an identical direction.

6. A switching device according to claim 2, wherein a plurality of moving contact members are juxtaposed to each other.

7. A switching device according to claim 3, wherein permanent magnets arranged on the two end sides of said moving contact member are arranged in polarity in an identical direction.

8. A switching device according to claim 4, wherein permanent magnets arranged on the two end sides of said moving contact member are arranged in polarity in an identical direction.

* * * * *